United States Patent [19]

Dufour

[11] Patent Number: 4,683,624

[45] Date of Patent: Aug. 4, 1987

[54] METHOD FOR STEAMING A PAPERMAKER'S FABRIC

[75] Inventor: Marcel Dufour, Saint Yrieix, France

[73] Assignee: Cofpa, France

[21] Appl. No.: 822,292

[22] Filed: Jan. 24, 1986

[30] Foreign Application Priority Data

Feb. 19, 1985 [FR] France ..... 85 02349

[51] Int. Cl.[4] ..... D06H 5/00

[52] U.S. Cl. ..... 28/141; 28/142

[58] Field of Search ..... 28/107, 141, 142, 110; 139/383 AA; 162/348; 156/148, 258, 159, 304.5, 304.7

[56] References Cited

U.S. PATENT DOCUMENTS

| | | | |
|---|---|---|---|
| 3,230,599 | 1/1966 | McKew et al. | 28/110 |
| 4,141,388 | 2/1979 | Romanski et al. | 139/383 |
| 4,279,676 | 7/1981 | Morrison et al. | 156/159 |
| 4,403,632 | 9/1983 | Romanski et al. | 139/383 |

FOREIGN PATENT DOCUMENTS

| | | | |
|---|---|---|---|
| 0108733 | 5/1984 | European Pat. Off. . | |
| 0151705 | 8/1985 | European Pat. Off. . | |
| 1956412 | 6/1971 | Fed. Rep. of Germany | 156/148 |
| 2096659 | 10/1982 | United Kingdom | 28/107 |

*Primary Examiner*—Peter Chin
*Assistant Examiner*—Thi Dang
*Attorney, Agent, or Firm*—Benasutti and Murray

[57] ABSTRACT

A method for seaming the ends of a papermaker's fabric during installation on papermaking equipment is disclosed. The method comprising the steps of: providing a base fabric having a batt needled thereto such that one end of the batt extends beyond the corresponding end of the base fabric to overlap the opposing end of the batt when the ends of the base fabric are joined; joining the base fabric to form a continuous belt; overlapping the extended end of the batt upon its opposite end; cutting the overlapping batt ends across the width of the fabric such that the opposing batt ends are configured to complement each other; combing each of the complementary batt ends such that the fiber dispersion of the batt material is decreased and the ends of the batt are lengthened; overlapping the combed batt ends; and needling the overlapping combed batt ends together and to the base fabric such that the batt material of each end of the batt is interdispersed with each other and the resultant material is essentially the same as the remainder of the fiber batt.

3 Claims, 10 Drawing Figures

METHOD FOR STEAMING A PAPERMAKER'S FABRIC

BACKGROUND OF THE INVENTION

The present invention relates to seaming the ends of an absorbing papermaker's fabric to form an endless belt for use on papermaking equipment, specifically for seaming the ends of a wet felt as used in papermaking.

Conventionally, papermaking machines have three basic sections: the forming section, the wet press section, and the drying section. In the forming section, paper pulp, which is almost liquid, is introduced onto a permeable forming fabric. The forming fabric transports the aqueous paper pulp across suction boxes thereby forming an aqueous paper web or sheet having a concentration of approximately 20% dry matter, essentially cellulose or similar fibers.

The aqueous paper web is then transported on fabrics known as wet felts, between press rolls in the wet press section of the papermaking machinery. Such a felt generally comprises, an open-mesh base fabric having at least one batt needled thereto. The pressure of the press rolls causes the water to leave the paper web; the water runs through the interstices of the wet felts. Wet felts are designed such that marking and crushing of the aqueous paper web is avoided during the dewatering process.

The paper web exits the wet section of the papermaking equipment as a sheet of approximately 45% dry matter. Thereafter, the paper sheet is carried on fabrics, known as dryer felts, through the drying section of the papermaking equipment where more water is removed through evaporation as the paper is transported around heated rollers.

In the dryer section of the papermaking equipment, the paper sheet is more resistant to marking. Conventional techniques for seaming papermaker's fabrics for the dryer section of the papermaking machine have proven satisfactory.

In contrast with the dryer section, the aqueous paper web is much softer as it passes through the wet section of the papermaking equipment. Accordingly, the risk of marking the paper is much greater. Any variation in the thickness, composition, or surface texture of the papermaker's fabric may cause marking of the aqueous web as it passes through the press rollers.

As noted previously, a papermaker's wet felt may be comprised of a base fabric having one or more batts needled thereto. The base fabric is generally made of stiff and mechanically resistant woven yarns to withstand the tensions of the belt and to maintain a desired void volume for liquid to be extracted from the paper web during the manufacturing process. The batts are made of intermingled, generally fine and flexible fibers to form a soft surface. This permits the application of pressure to the aqueous paper web while it is transported by the wet felt through the wet section of a papermaking machine to extract liquid therefrom without marking it.

When fully installed on a papermaking machine, the wet felt is in the form of a continuous belt which transports the aqueous paper web through the papermaking equipment. Although it is possible to manufacture papermaker's fabrics as an endless loop, it is not always feasible to do so because the varying requirements of different types of papermaking equipment. Furthermore, there are, as known to those skilled in the art, practical limitations on the length of a felt which may be woven endless.

Generally, in lieu of an endless woven fabric, an open or flat woven fabric of a desired length is provided to the paper mill. The ends of the fabric are seamed when the fabric is installed on the papermaking equipment to form the required continuous belt. However, seaming the fabric ends is problematic since the seam may cause marking of the paper web as it transports the web through the nip of the press rollers of the papermaking equipment. It is important that the seam in a papermaker's fabric which is employed in the wet section of a papermaking machine has the same thickness and surface texture as the remainder of the fabric so that the aqueous paper web does not become marked.

There are techniques for seaming batt-on-base papermaker's fabrics known in the art. For example, it is known in the art to configure the ends of the base fabric with intermeshing loops which may be joined with the insertion of a pintle therethrough when the end loops are intermeshed. The thickness of the pintle which joins the base fabric ends is comparable to the thickness of the yarns which comprise the cross machine yarns of the base fabric so that the seam does not create a bulge in the fabric. The ends of the batts, which are configured to abut each other, are then secured in position to the base fabric through the application of an adhesive and/or needling along the seam of the batts.

European Patent application Publication No. 0 108 733 (Nordiskafilt AB) discloses such a method for joining the ends of a batt-on-base papermaker's wet felt. According to the teachings of that patent, the base fabric of the wet felt is first manufactured and its ends are joined together in a conventional manner, such as through the insertion of a pintle discussed above. Thereafter at least one flexible fiber batt is needled onto the entirety of at least one surface of the base fabric, a portion of the batt material covering the seam in the base fabric. The batt material is then cut across the width of the fabric parallel to and a short distance behind the seam in the base fabric. Thereafter, the portion of the batt material, extending longitudinally from the cut is loosened across the seam and lifted off the base fabric to permit removal of the joining pintle so that the ends of the fabric can be disconnected.

Through this process, a flap of batt material which extends beyond one end of the base fabric is created. The flap abuts, but does not overlap, the other end of the batt when the base fabric is seamed.

When such a felt is installed on a papermaking machine, its ends are rejoined to configure the wet felt into an endless belt. The base fabric is first seamed together through the insertion of the joining pintle. Thereafter, the flap of batt material is returned to its original position abutting the other end of the batt. The flap of batt material may be bonded in place through the use of an adhesive and/or by needling the ends of the batt to the base fabric.

In practice, the abutting ends of the batt along the seam of the batt material may intermesh slightly, on the order of approximately one half the thickness of the batt. However, the seam of the batt may exhibit some discontinuities or irregularities with respect to the paper web supporting surface of the wet felt defined by the batt.

The resultant seamed fabric disclosed in E.P.O. Publication No. 0,108,733 provides a relatively good seam for its intended purpose. However, due to the highly deformable nature of the aqueous paper web as it is transported by the wet felt, some marking of the paper web which is attributable to the seam still occurs.

The specific purpose of the present invention is to obtain a good continuity between the two ends of the batt after the junction of the base fabrics.

SUMMARY AND OBJECTS OF THE INVENTION

The present invention provides an improved method for seaming the ends of a batt-on-base papermaker's fabric thereby providing an improved papermaker's fabric. An apparatus used in the performance of the method is also taught.

The base fabric of a papermaker's felt is manufactured in a conventional matter including means for joining the two ends of the base fabric together. At least one fiber batt is needled onto at least one side of the base fabric. The batt is longer than the base fabric, and the needling operation joining the batt to the base is omitted proximate the seam of the base fabric such that a flap or overlap of batt material is created at one end of the papermaker's fabric. The flap of batt material extends a sufficient distance from the associated base fabric end, such that, when the ends of the base fabric are joined, the flap of batt material overlaps the other end of the batt.

The ends of the papermaker's fabric are then joined together by first joining the ends of the base fabric, the overlapping flap of the batt material being lifted to facilitate the coupling of the ends of the base fabric. The flap of batt material is then returned to cover the surface of the base fabric, including the base fabric seam, and overlaps the opposite end of the batt.

A single cut across the width of the fabric is then made through the overlapping batt portions to prepare for splicing the ends of the batt together. After any excess batt material is removed, the overlapping end portion abuts the other end of the batt in a complementary fashion. The splice cut is preferably made on an angle downwardly towards the base fabric seam.

A combing or carding is then performed on each end of the batt for a length equal to at least the thickness of the batt. This process has the effect of elongating the ends of the batt so that they again overlap. This process also eliminates, at least partially, the dispersion of fibers in the combed sections of the batt.

The end flap of the batt is then replaced over the opposite batt end and a final needling of the batt material to the underlying base fabric is made. This needling step has the effect of refelting or redispersing the combed end portions of batt material such that the composition of the seaming area has essentially the same uniform internal construction, density, thickness and surface texture as the remainder of the batt. The refelted seam portion of the batt has a longitudinal dimension at least twice the thickness of the batt since the carding of each batt end is performed for a length at least equal to the thickness of the batt material.

The process results in the formation of a seamed fabric having an essentially seamless batt thereon.

The present invention also has applicability where the wet felt comprises a plurality of batts on one or both sides of the base fabric. Where multiple layers of batt material are employed on one side of the base fabric, the formation of a refelted seam portion of each layer of batt material is performed in accordance with the above described method, preferably, such that the seaming areas are staggered along the length of the fabric.

To accomplish the final needling process in situ on a papermaking machine, a special apparatus is provided. The apparatus comprises a conventional reciprocating power hand saw having a special needling tool mounted in the chuck generally provided for the saw blade. The needling tool comprises a plate or base having a plurality of depending barbed needles projecting therefrom such that reciprocation of the needles through the fabric affects the needling operation.

It is an object of the present invention to provide an improved method for seaming the ends of a papermaker's fabric to obtain a good continuity across the surface of the fabric after the base fabric has been joined.

It is another object of the present invention to provide an improved seamed papermaker's fabric having an essentially seamless batt layer partially formed in situ during installation of the papermaker's fabric.

It is a further object of the present invention to provide an apparatus for facilitating the in situ formation of the refelted portion of batt material.

Other objects and advantages of the present invention will become apparent for the following portion of the specification and from the accompanying drawings which illustrate a presently preferred embodiment incorporating the principles of the invention.

BRIEF DESCRIPTION OF THE DRAWINGS

FIG. 2 shows the joined base fabric with the angled splice cut accomplished in the batt;

FIG. 3 shows the result of the combing operation depicted in FIG. 2;

FIG. 4 shows the overlying combed batt ends;

FIG. 5 shows the final needling operation and the resultant substantially planar felt;

FIG. 8 shows a papermaker's fabric having two batts needled to a base fabric such that each batt includes an overlapping end portion which extends across the base fabric seam and overlaps the respective opposite end of each batt;

FIG. 9 shows the fabric after the angled splice cut has been made in each batt; and FIG. 10 depicts the resultant seamed papermaker's fabric.

DETAILED DESCRIPTION OF THE PREFERRED EMBODIMENT

Figure 1:
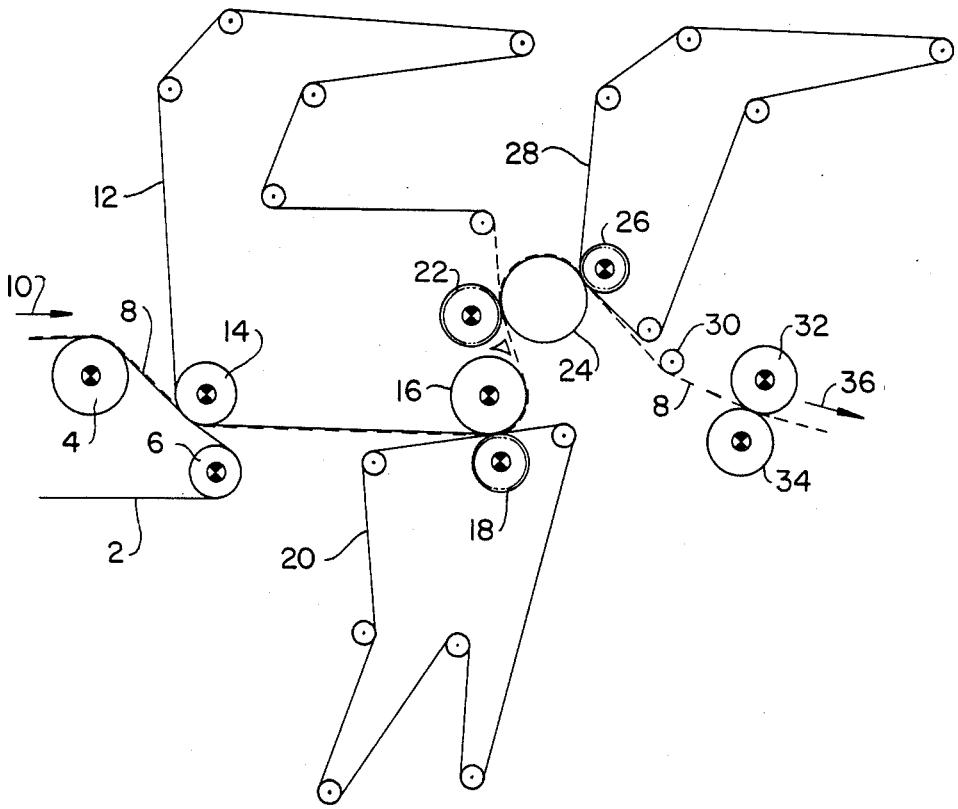
FIG. 1 is a schematic view of the wet end of a papermaking machine.

Referring to FIG. 1, there is shown the wet section of a papermaking machine for producing paper, such as news print. An absorbing fabric 2 which runs on rolls 4, 6 conveys an aqueous paper web 8 in the direction 10 to the wet section of the papermaking machine. At this point, the paper web is a highly deformable sheet which comprises approximately 20% dry matter.

The paper web is taken off the absorbing fabric 2 by a wet felt 12 through roller 14. A first pair of pressure rollers 16, 18 aids a first liquid extraction from the aqueous web 8 as it is transported therethrough between the first felt 12 and a second felt 20. A second pair of rollers 22, 24 aids a second liquid extraction. The paper web 8 is then carried by a polished granite roll 24 to a third pressing area formed by the granite roll 24 and roll 26 on which a third wet felt 28 runs.

After being conveyed through the three press sections, the aqueous paper web comprises approximately 45% dry matter. Rolls 30, 32 and 34, then guide the web 8 according to arrow 36 toward the dryer section of the papermaking machine (not shown).

The running speed of the aqueous web through the press can be as high as 2000 meters per minute. The pressures that ensure water removal can be as great as 1100 kN per centimeter of width of the felt between rolls. The diameters of the rolls vary between 0.4 and 2 meters. The roll diameters can be decreased but would then result in lowering the water-removal efficiency and the increased energy consumption in the dryer section that follows. Under these conditions, any appreciable thickness variation of the wet felts which carry the aqueous web 8 through the pressing sections can cause an indelible mark on the paper web.

Figure 2:
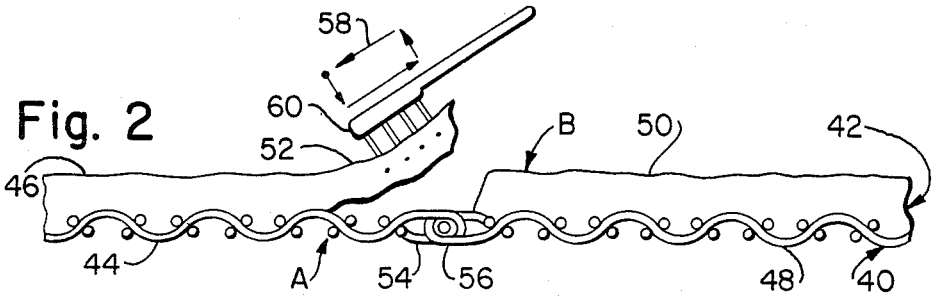
FIGS. 2, 3, 4, and 5 are a succession of side views of the ends of papermaker's wet felt being joined in accordance with the teachings of the present invention.

Referring to FIG. 2, a felt, such as felt 12 which transports the paper web while it is still very wet and soft generally comprises a base fabric 40 having a batt 42 selectively needled thereto. Both the base fabric and the batt are substantially uniform in thickness, density and surface texture to provide a suitable means for transporting the deformable paper web.

In one embodiment, the base fabric is comprised of interwoven polyamide yarns having a diameter of approximately 0.8 mm; the batt 42 preferably has a non-compressed thickness of 3 mm and is comprised of polyamide fibers needled onto themselves and then onto the base fabric having a diameter less then 0.1 mm. The density of the batt is preferably 0.230 grams per cubic centimeter. It will be understood by those skilled in the art that the base fabric may be nonwoven, such as a spiral base fabric formed by interlocking a plurality of thermoset helices.

The wet felt 12 is installed on the papermaking equipment around the rolls in the form of an open belt of a desired length. The length of such an open fabric is not limited to the size of the weaving looms upon which the base fabric is manufactured, as is the case with fabrics that are woven endless. After the wet felt has been threaded through its serpentine path around the rollers of the papermaking machine, the ends of the wet felt are joined to form a continuous belt which is then placed under tension.

The procedure for joining the ends of the fabric is described below with reference to FIGS. 2 through 5. The first end of the felt, i.e. the end which precedes the seam into the press rollers, generally identified as A, comprises a first end 44 of the base fabric 40 and a first end 46 of the batt 42; the second end of the felt, which follows the first end into the press rollers in service, generally identified as B, comprises the second end 48 of the base fabric 40 and the second end 50 of the batt 42.

When the wet felt is manufactured, the needling of the batt 42 is omitted on the first end A of the fabric proximate to and across the seam of the base fabric 40. An overlap portion or flap 52 of batt material is thereby formed at the first end A of the fabric sufficient to overlap upon the second end 50 of the batt when the ends 44, 48 of the base fabric 40 are joined together via a pintle 56.

The ends 44, 48 of the base fabric are manufactured in a conventional manner to terminate in loops 54, across the width of the fabric. When the fabric is installed on the papermaking machine, the loops of the first end 44 of the base fabric are intermeshed with the loops of the second end 48 of the base fabric and a pintle, or joining reed, 56 is inserted therethrough to form the base fabric seam.

The pintle 56 is generally stiffer then the cross direction yarns of a woven base fabric and may have a diameter of approximately 1 mm. The base fabric is designed such that the thickness of the seam area of the base fabric is only slightly varied, if at all, from the remainder of the base fabric 40. In lieu of a woven base fabric, a base fabric comprised of linked spirals, as will be known to those skilled in the art, may be employed. In such an instance, the joining pintle is identical to the cross direction yarns joining the adjacent spirals of the fabric. Conventional means are employed to insure the mutual blocking of the various yarns of the base fabric to prevent it from coming apart.

After the ends of the base fabric have been joined, the flap 52 of batt material from first end A is laid over the second end B and overlaps the opposite end 50 of the batt 42. A splice cut is made through the two overlapping ends of the batt across the width of the felt, parallel to and slightly behind the seam in the base fabric. After the excess batt material is removed, the two ends 46, 50 of the batt 42 abut each other in a complementary fashion. Preferably, the splice cut is made in angle through the batt material towards the seam of the base fabric.

Figure 3:
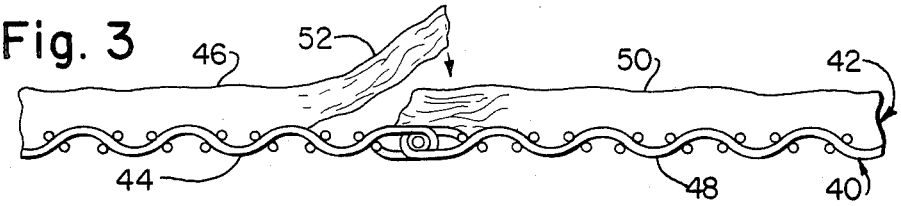
Figure 4:
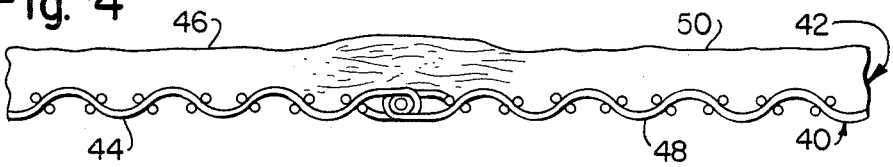
Figure 5:
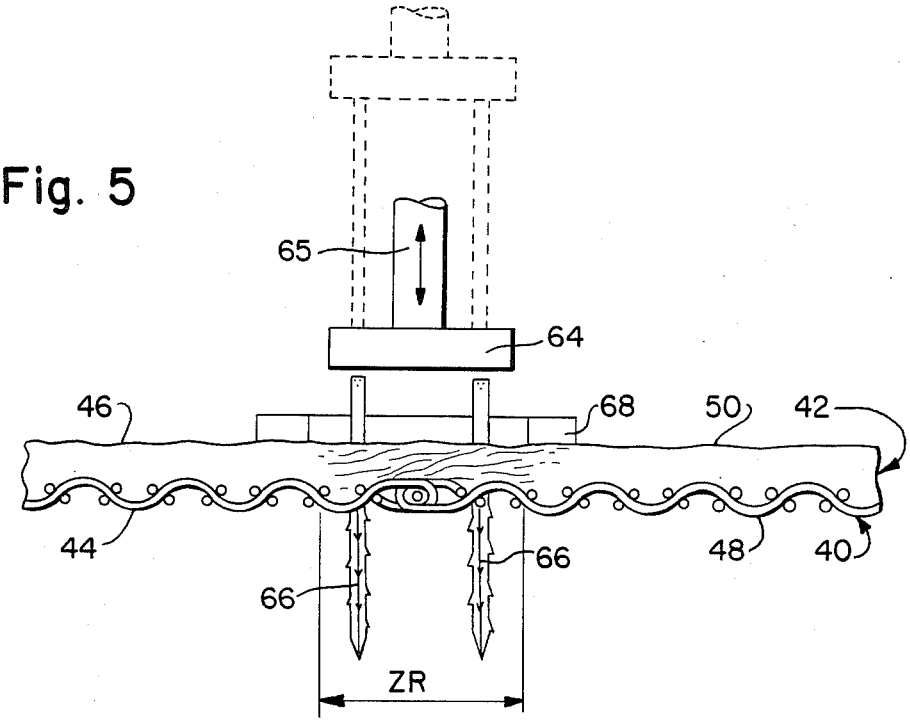
Figure 6:
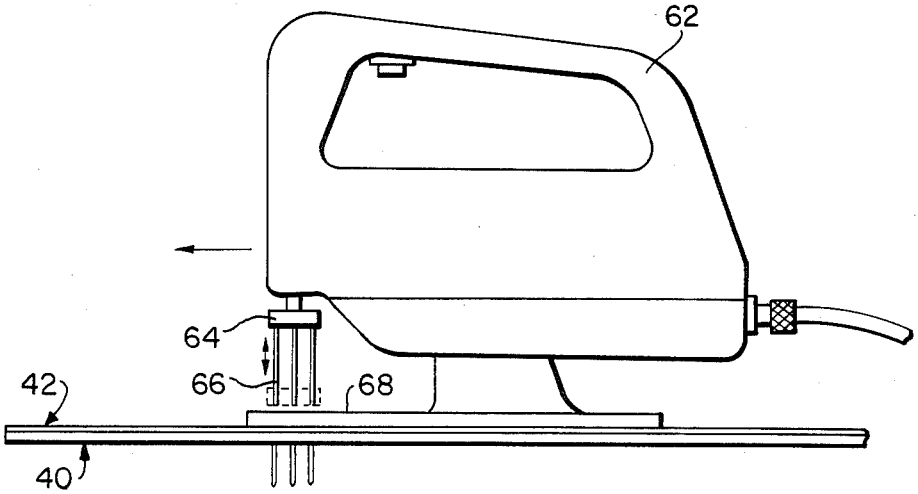
FIG. 6 is an elevated view of the papermaker's wet felt depicted in FIG. 2 during the final needling step further showing a needling apparatus made in accordance with the teachings of the present invention.
Figure 7:
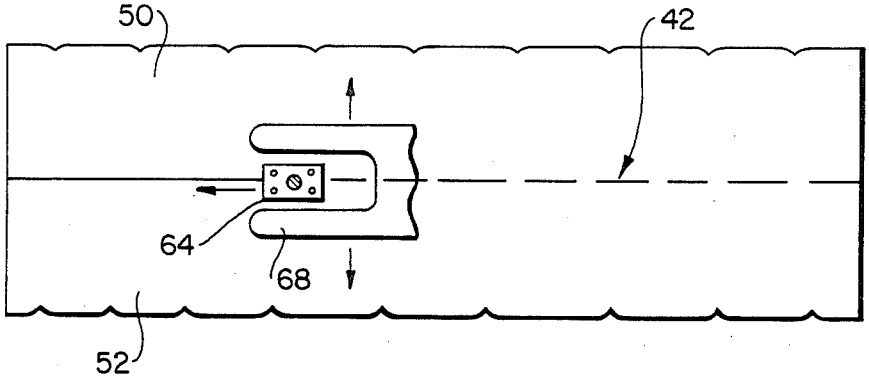
FIG. 7 is a top view of the papermaker's felt and needling apparatus shown in FIG. 6 having a portion of the apparatus cut away to show the needling tool.

Thereafter, as best seen in FIG. 2, a combing or carding process is performed using a brush or comb 60 as will be known to those skilled in the art as a hand comb. The comb 60 is reciprocated in the manner indicated by arrows 58. Combing is performed on each end 46, 50 of the batt 42 for a longitudinal distance, measured from the splice cut, of at least the thickness of the batt 42. During the combing process, the ends of the batts are elongated while giving them a density which decreases towards the loose extremity. At the same time, the dispersion of the fibers and the cohesion of the batt material is decreased as illustrated in FIG. 3. The combed flap portion 52 of the first end 46 of the batt is then repositioned over the combed portion of the second end 50 of the batt 42 as shown in FIG. 4. Thereafter, a final needling process is performed as shown in FIGS. 5, 6 and 7.

The final needling step is performed with an apparatus specifically developed to perform this process. The apparatus comprises a conventional reciprocating portable power hand saw motor 62 having a special needling tool. The needling tool comprises a small plate or base 64, approximately 1.4 centimeters in width and 2.5 centimeters in length, having two rows of vertical needles 66 mounted thereon. The needles are approximately 3 cm in length with a triangular cross section having edges locally deformed to form barbs. Such needles are used in conventional needling process during the manufacture of the wet felt. A mounting shaft 65 is secured to base 64 and is configured to be received and held by the chuck of the power saw. The needling tool is mounted in the chuck of the saw motor which reciprocates the needles perpendicular to the template or guide 68 through the plane of the fabric as shown in FIGS. 5 and 6.

The final needling is applied across the width of the fabric over the entirety of flap 52 and the combed portions of the batt 42. The needling process is conducted until the thickness, density and surface texture of the refelted end portions of the batt is substantially the same as the other portions of batt material. The guide 68 of the needling equipment 62 is maintained flush with the fabric's surface during the needling operation to insure the verticality of the needling work to achieve the desired result.

The final needling process serves three primary functions: it attaches the flap 52 and extreme ends of the batt 42 to the underlying base fabric 40; it establishes a mechanical continuity between the ends of the fabric; and it remanufactures or refelts the batt material into a uniform structure which is homogeneous with the remainder of the batt 42. In essence the refelting of the combed batt material from the two ends of the batt creates an endless transporting surface which is uniform in both texture and compressibility.

As shown in FIG. 5, the refelted area of the batt has a length ZR which is equal to at least twice the thickness of the batt 42, since the combing operation was performed on each end of the batt for at least a distance equal to the thickness of the batt.

Figure 8:
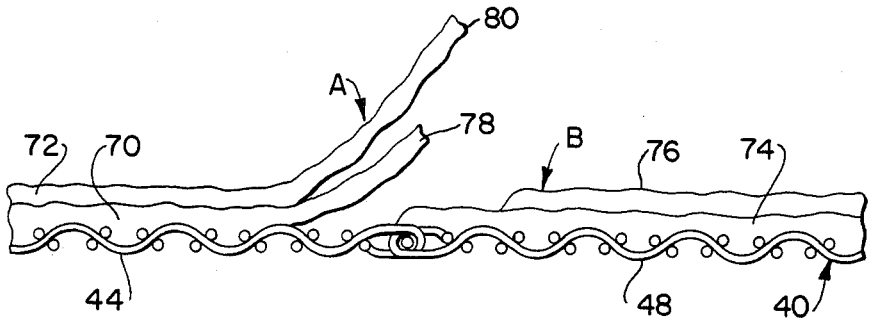
FIGS. 8, 9, and 10 are a series of side views of the ends of another embodiment of a papermaker's wet felt having multiple batts being joined in accordance with the teachings of the present invention.
Figure 9:
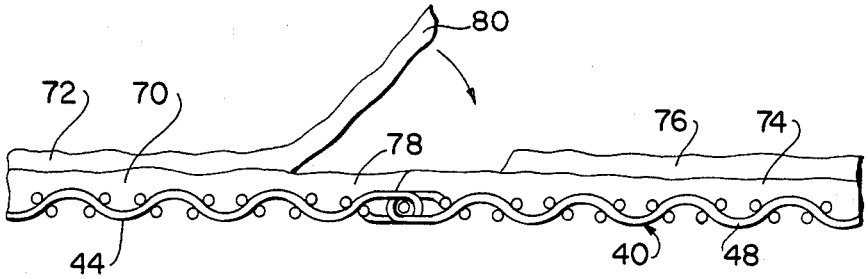
Figure 10:
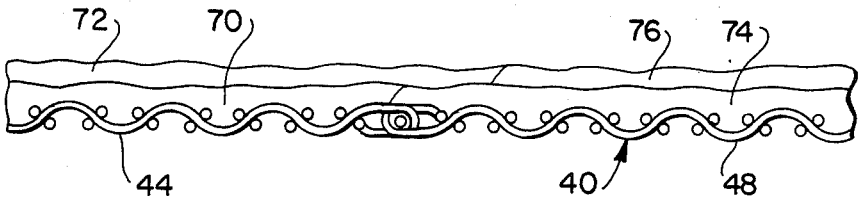

The disclosed method for joining the ends of a wet felt described above can be adapted to join the ends of a felt having multiple layers of batt material. Referring to FIGS. 8, 9 and 10, during the manufacture of the wet felt the base fabric 40 is manufactured as discussed above. However, two layers of batt material are needled to the base fabric 40 instead of one.

The needling process of the batt material onto the base fabric 40 is omitted on the first ends 70, 72 of the batts thereby creating flaps 78, 80 which extend beyond the first end 44 of the base fabric 40 such as is shown in FIG. 8. The flap 80 of the top layer of batt material extends beyond the flap 78 of the bottom layer of batt material corresponding to a like staggering of the second ends 74, 76 of the batts.

After the ends 44, 48 of the base fabric 40 have been joined, each batt is cut to splice the respective ends 70, 74, 72, 76 of the two batt layers together as discussed above. Accordingly, the ends of each layer are thus configured to abut each other in a complementary fashion as shown in FIGS. 9 and 10. The combing procedure, discussed above, is then conducted on at least the ends 72, 76 of the top layer of the fabric. The batt ends are then replaced in an overlapping fashion and the final needling thereof is executed to refelt the respective ends of the batt layers to form a continuous, homogeneous paper supporting surface.

Referring again to FIG. 1, the present invention is particularly beneficial in the manufacture of paperboard. A papermaking felt of this type used under these conditions is called a long-bottom felt or a long-top felt.

It serves to form the board sheet 8 by running on a succession of pulp feeding rolls. It is a light type felt, (1,000 grams per square meter, maximum), to first insure the draining off of the pulp by normal gravity; i.e., without pressure. However, it may also pass through the pressing sections to forcibly extract liquid from the aqueous paper sheet.

Under this condition, the splice cut of the batt material with a razor, as disclosed in E.P.O. Publication No. 0,108,733, for example, is difficult to accomplish and may reduce both the life of the felt and the performance of the felt because the joining area of the batt has an insufficient fiber density to hold up while the felt is running on a papermaking machine. The present invention permits the use of a flat woven fabric since the refelting of the batt material in situ enables the batt to maintain its shape and dimensions while the felt is running on a papermaking machine.

The invention also appears desirable in the manufacture of wadding (very lightweight sheet; from 15 to 20 grams period per square meter) where even a moderate discontinuity brought about by a slash in the batt material of a seamed wet felt can create a relatively appreciable variation in the consistency of the sheet produced. The present invention under these conditions permit the use of a seamed felt as a "pick up, take up and friction" felt.

What is claimed is:

1. A method for seaming the ends of a papermaker's fabric during installation on papermaking equipment comprising:

(a) providing a base fabric having at least a first batt needled thereto such that one end of the batt extends beyond the corresponding end of the base fabric a sufficient distance to overlap the opposing end of the batt when the ends of the base fabric are joined;

(b) joining the opposing ends of the base fabric to form a continuous belt;

(c) overlapping the extended end of the batt upon its opposite end;

(d) cutting the overlapping batt ends across the width of the fabric such that the opposing batt ends are configured to complement each other;

(e) combing each of the complementary batt ends for a length equal to at least the thickness of the batt such that the fiber dispersion of the batt material is decreased and the ends of the batt are lengthened;

(f) overlapping the combed batt ends; and (g) needling the overlapping combed batt ends together and to the base fabric such that the batt material of each end of the batt is interdispersed with each other and the resultant material has essentially the same uniform internal construction, density, thickness and surface texture as the remainder of the fiber batt.

2. A method for seaming a papermaker's fabric according to to claim 1 further comprising:

(a) providing at least a second batt between said base fabric and said first batt such that the ends of said second batt are longitudinally between the corresponding ends of said base fabric and said first batt; and (b) overlapping and splice cutting the ends of said second batt to complement each other after the base fabric is joined.

3. A method for seaming a papermaker's fabric according to claim 2 further comprising:

(a) combing the complementary ends of said second batt for a length equal to at least the thickness of the second batt such that the fiber dispersion of the batt material is decreased and the ends of the second batt are lengthened;

(b) overlapping the combed batt ends; and (c) needling the overlapping combed batt ends together and to the base fabric such that the batt material of each end of the second batt is interdispersed with each other and the resultant material has essentially the same uniform internal construction, density, thickness and surface texture as the remainder of the second batt.

* * * * *

UNITED STATES PATENT AND TRADEMARK OFFICE

CERTIFICATE OF CORRECTION

PATENT NO. : 4,683,624

DATED : August 4, 1987

INVENTOR(S) : Marcel Dufour

It is certified that error appears in the above-identified patent and that said Letters Patent is hereby corrected as shown below:

In the title, (54)"STEAMING" should read --SEAMING--

Signed and Sealed this

Eighth Day of December, 1987

*Attest:*

DONALD J. QUIGG

*Attesting Officer*

*Commissioner of Patents and Trademarks*